US007766793B2

(12) United States Patent
Hashimoto

(10) Patent No.: US 7,766,793 B2
(45) Date of Patent: Aug. 3, 2010

(54) PASSIVE-TYPE EXERCISING DEVICE AND ITS CONTROL DEVICE

(75) Inventor: Masahiko Hashimoto, Toyonaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 12/361,821

(22) Filed: Jan. 29, 2009

(65) Prior Publication Data

US 2009/0197739 A1 Aug. 6, 2009

(30) Foreign Application Priority Data

Feb. 1, 2008 (JP) ..... 2008-023150

(51) Int. Cl.
*A63B 21/005* (2006.01)

(52) U.S. Cl. ..... 482/6

(58) Field of Classification Search ..... 482/1–9, 482/92, 94, 101–106, 900–902; 434/247
See application file for complete search history.

(56) References Cited

U.S. PATENT DOCUMENTS 5,314,394 A * 5/1994 Ronan ..... 482/104
6,027,429 A * 2/2000 Daniels ..... 482/5
7,070,539 B2 * 7/2006 Brown et al. ..... 482/8
2007/0219059 A1 * 9/2007 Schwartz et al. ..... 482/8

FOREIGN PATENT DOCUMENTS

JP 2007-260182 A 10/2007

* cited by examiner

*Primary Examiner*—Glenn Richman
(74) *Attorney, Agent, or Firm*—NDQ&M Watchstone LLP

(57) ABSTRACT

A passive-type exercising device and its control device are provided in which accuracy of deriving exercise intensity is improved. The passive-type exercising device includes an exercise assistance mechanism for assisting exercise of a user; a load setting value acquisition unit 131 for obtaining a load setting value which is a setting value of a degree that the exercise assistance mechanism assists the user's exercise; an assistance load value derivation unit 132 for deriving an assistance load value that the exercise assistance mechanism assists the user's exercise; a sensor value acquisition unit 134 for obtaining a sensor value outputted by a sensor unit 32 provided at the exercise assistance mechanism; a combined load value derivation unit 135 for deriving a combined load value which is a combined value of the assistance load value and an effective load value of the user's active exercise based on the obtained sensor value; and an exercise intensity derivation unit 150 for deriving an exercise intensity indicating the user's exercise intensity based on the effective load value computed as a difference between the assistance load value and the combined load value.

10 Claims, 12 Drawing Sheets

PASSIVE-TYPE EXERCISING DEVICE AND ITS CONTROL DEVICE

CROSS REFERENCE TO RELATED APPLICATIONS

This application claims priority based on 35 USC 119 from prior Japanese Patent Application No. P2008-023150 filed on Feb. 1, 2008, the entire contents of which are incorporated herein by reference.

BACKGROUND OF THE INVENTION

1. Field of the Invention

The invention relates to a passive-type exercising device having an exercise assistance mechanism for assisting exercise of a user as well as applying an exercising load to the user by operating in a predetermined operation pattern and its control device.

2. Description of Related Art

A passive-type exercising device that is used passively by a user has been known in the past. Such a passive-type exercising device includes an exercise assistance mechanism for applying an exercising load to the user as well as assisting exercise of the user by operating in a predetermined operation pattern such as vertical motion, turning, and oscillation, and a control device for controlling the exercise assistance mechanism.

In particular, the user that utilizes the passive-type exercising device can exercise easily for example by mounting on the exercise assistance mechanism by which a part of the body is moved and the exercising load is reduced.

Also, the more the user actively exercises while being assisted by the exercise assistance mechanism, the larger the exercising load actually applied to the user becomes, thus increasing exercise intensity such as MET; Metabolic Equivalent which indicates the user's exercise intensity. Here, MET is a unit that expresses the exercise intensity by how many times of the resting conditions it corresponds to, in which sitting in a resting state corresponds to 1 MET and average walking corresponds to 3 METs.

In such a passive-type exercising device, when a control device derives the exercise intensity, the following method was proposed. In particular, the passive-type exercising device described in Japanese Patent Laid-Open No. 2007-260182 computes the exercise intensity from outputs of a sensor provided at the exercise assistance mechanism. Also, the user's mounting method is determined by the change of the integrated electric power or the drive current magnitude of a drive unit that drives the exercise assistance mechanism, and the exercise intensity that is corrected in accordance with the mounting method is computed.

However, Japanese Patent Laid-Open No. 2007-260182 does not disclose a specific correction method for the exercise intensity. In other words, with the method described in Japanese Patent Laid-Open No. 2007-260182, the exercise intensity may not necessarily be computed with high accuracy. Thus, there has been a room for improvement in the past methods for deriving the exercise intensity in the passive-type exercising device in terms of improved accuracy in deriving the exercise intensity.

SUMMARY OF THE INVENTION

The invention was made in consideration of the above and it provides a passive-type exercising device in which accuracy for deriving the exercise intensity is improved when deriving the exercise intensity in the passive-type exercising device and its control device.

One aspect of the invention is a passive-type exercising device (passive-type exercising device 10) having an exercise assistance mechanism (exercise assistance mechanism 10*a*) for assisting exercise of a user as well as applying an exercising load to the user by operating in a predetermined operation pattern such as vertical motion and turning, in which the exercise assistance mechanism includes a load setting value acquisition unit (load setting value acquisition unit 131) for obtaining a load setting value which is a setting value for amplitude of the exercising load applied to the user by the exercise assistance mechanism; an assistance load value derivation unit (assistance load value derivation unit 132) for deriving an assistance load value indicating amplitude of the exercising load reduced by the exercise assistance mechanism's assisting the exercise of the user; a sensor (sensor unit 32) provided to the exercise assistance mechanism; a sensor value acquisition unit (sensor value acquisition unit 134) for obtaining a sensor value outputted by the sensor indicating an operation intensity of the exercise assistance mechanism; a combined load value derivation unit (combined load value derivation unit 135) for deriving a combined load value which is a combined value of the assistance load value and an effective load value indicating amplitude of the exercising load applied to the user by the user's active exercise based on the sensor value obtained at the sensor value acquisition unit; and an exercise intensity derivation unit (exercise intensity derivation unit 150) for deriving an exercise intensity indicating the intensity of the user's exercise based on the effective load value computed as a difference between the assistance load value derived at the assistance load value derivation unit and the combined load value derived at the combined load value derivation unit.

In such a passive-type exercising device, the assistance load value derivation unit derives the assistance load value based on the load setting value that is a setting value for the amplitude of the exercising load. Such an assistance load value reflects the part contributed by the exercise assistance mechanism (the assisted part) to the operation intensity of the exercise assistance mechanism.

The combined load value derivation unit derives the combined load value based on the sensor value indicating the operation intensity of the exercise assistance mechanism outputted by the sensor provided at the exercise assistance mechanism. Such a combined load value reflects the intensity of the actual operation of the exercise assistance mechanism.

The exercise intensity derivation unit derives the exercise intensity based on the effective load value computed as the difference between the assistance load value and the combined load value. In other words, within the operation intensity of the exercise assistance mechanism, the part contributed by the exercise assistance mechanism (the assisted part) is removed from the operation intensity of the exercise assistance mechanism is the exercising load (effective load value) actually applied to the user.

By deriving the exercise intensity (such as METs) from such an effective load value, it becomes possible to obtain the exercise intensity that accurately reflects the amplitude of the exercising load actually applied to the user from the active exercise of the user by removing the part assisted by the exercise assistance mechanism. Therefore, the control device with increased accuracy for deriving the exercise intensity can be provided.

In such a passive-type exercising device, a heart rate acquisition unit (heart rate acquisition unit 139) for obtaining the user's heart rate further may be provided. The exercise intensity derivation unit may include a memory unit (memory unit 152) for storing in advance a plurality sets of correspondence relationship information defining the relationships between the user's heart rate and the exercise intensity for different exercise intensity amplitudes; a specifying unit (specifying unit 153) for specifying correspondence relationship information that corresponds to the effective load value computed as a difference between the assistance load value and the combined load value; and an exercise intensity acquisition unit (exercise intensity acquisition unit 154) for obtaining the exercise intensity corresponding to the heart rate obtained at the heart rate acquisition unit by referring to the correspondence relationship information specified by the specifying unit.

The passive-type exercising device according to the invention further may include a derived result notification unit (such as display unit 120) for notifying the user at least one of the exercise intensity derived at the exercise intensity derivation unit and the effective load value computed as a difference between the assistance load value and the combined load value.

The passive-type exercising device in accordance with the invention further may include a difference notification unit (such as the display unit 120) that provides to the user a notification in accordance with the difference between the effective load value and a desired load value which is a desired value for the effective load value or a notification in accordance with the difference between the exercise intensity corresponding to the effective load value and the exercise intensity corresponding to the desired load value.

The passive-type exercising device according to the invention further may include an exercise time acquisition unit (exercise time acquisition unit 137) for obtaining the user's exercise time; a multiplication unit (multiplication unit 136) that multiplies the exercise intensity derived at the exercise intensity derivation unit and the exercise time obtained at the exercise time acquisition unit; and a multiplication result notification unit (such as the display unit 120) for notifying to the user the multiplication result of the multiplication unit.

The passive-type exercising device according to the invention further may include a body weight acquisition unit (body weight acquisition unit 138) for obtaining the user's body weight, and the multiplication unit may obtain a product of multiplication of the exercise intensity derived at the exercise intensity derivation unit, the exercise time obtained at the exercise time acquisition unit, the body weight obtained at the body weight acquisition unit, and a predetermined coefficient.

The passive-type exercising device according to the invention further may include a load setting value adjustment unit (load setting value adjustment unit 142) for adjusting the load setting value in accordance with a comparison result between a target exercise intensity which is a target value for the user's exercise intensity and the exercise intensity derived at the exercise intensity derivation unit. The load setting value adjustment unit increases the load setting value when the exercise intensity derived at the exercise intensity derivation unit falls below the target exercise intensity, while the load setting value adjustment unit decreases the load setting value when the exercise intensity derived at the exercise intensity derivation unit exceeds the target exercise intensity.

The passive-type exercising device according to the invention further may include an operation abort unit (the load setting value adjustment unit 142 and drive control unit 160) for stopping an operation of the exercise assistance mechanism when the difference between the target exercise intensity which is a target value of the user's exercise intensity and the exercise intensity derived at the exercise intensity derivation unit exceeds a predetermined value.

The passive-type exercising device according to the invention further may include a voltage value acquisition unit (power supply voltage value acquisition unit 133) for obtaining a voltage value of the power supply (power unit 50) that supplies electricity to the drive unit (drive unit 31) provided at the exercise assistance mechanism, and the assistance load value derivation unit may correct the assistance load value in accordance with the fluctuation of the voltage value obtained at the voltage value acquisition unit.

Another aspect of the invention is a control device (control device 100) for controlling the exercise assistance mechanism for assisting exercise of the user as well as applying an exercising load to the user by operating in a predetermined operation pattern, in which the control device includes a load setting value acquisition unit for obtaining a load setting value which is a setting value for amplitude of the exercising load applied to the user by the exercise assistance mechanism; an assistance load value derivation unit for deriving an assistance load value indicating amplitude of the exercising load reduced by the exercise assistance mechanism's assisting the exercise of the user; a sensor value acquisition unit for obtaining a sensor value outputted by a sensor provided at the exercise assistance mechanism indicating the operation intensity of the exercise assistance mechanism; a combined load value derivation unit for deriving a combined load value which is a combined value of the assistance load value and an effective load value indicating amplitude of the exercising load applied to the user by the user's active exercise based on the sensor value obtained at the sensor value acquisition unit; and an exercise intensity derivation unit for deriving an exercise intensity indicating the intensity of the user's exercise based on the effective load value computed as a difference between the assistance load value derived at the assistance load value derivation unit and the combined load value derived at the combined load value derivation unit.

According to the invention, the passive-type exercising device and its control device with an improved accuracy in deriving the exercise intensity can be provided.

DETAILED DESCRIPTION OF EMBODIMENTS

Figure 1:
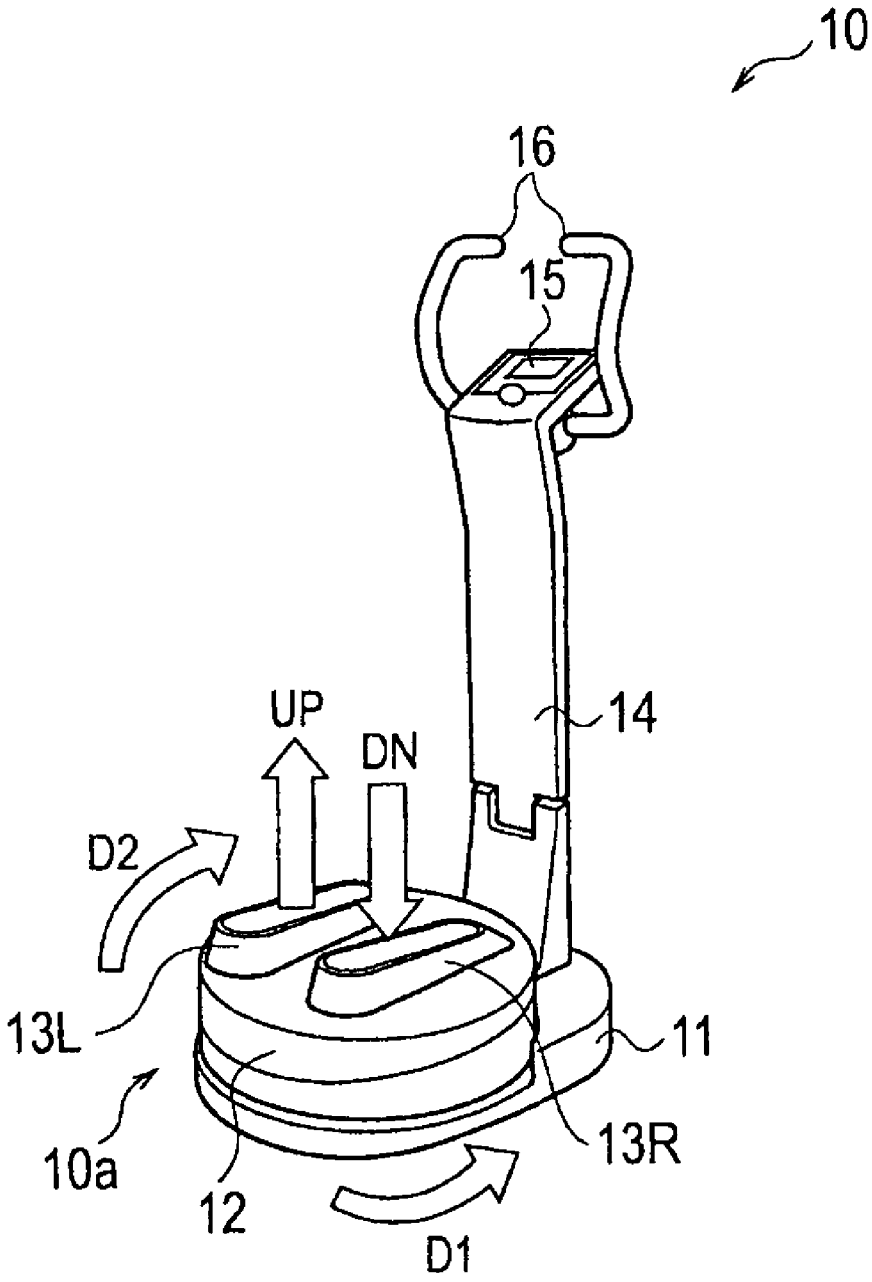
FIG. 1 is an overall general configuration diagram of the passive-type exercising device according to an embodiment of the invention.

Next, embodiments of the invention will be described with reference to the accompanying drawings below. In particular, (1) overall general configuration of the passive-type exercising device, (2) configuration of the control device, (3) derivation processing of the effective load value and the exercise intensity, (4) operations of the control device, (5) operations and effects, and (6) other embodiments of the invention will be explained. The same or similar reference numbers are used for the same or similar parts in the drawings for the embodiments as described below.

(1) Overall General Configuration of the Passive-Type Exercising Device

Figure 2:
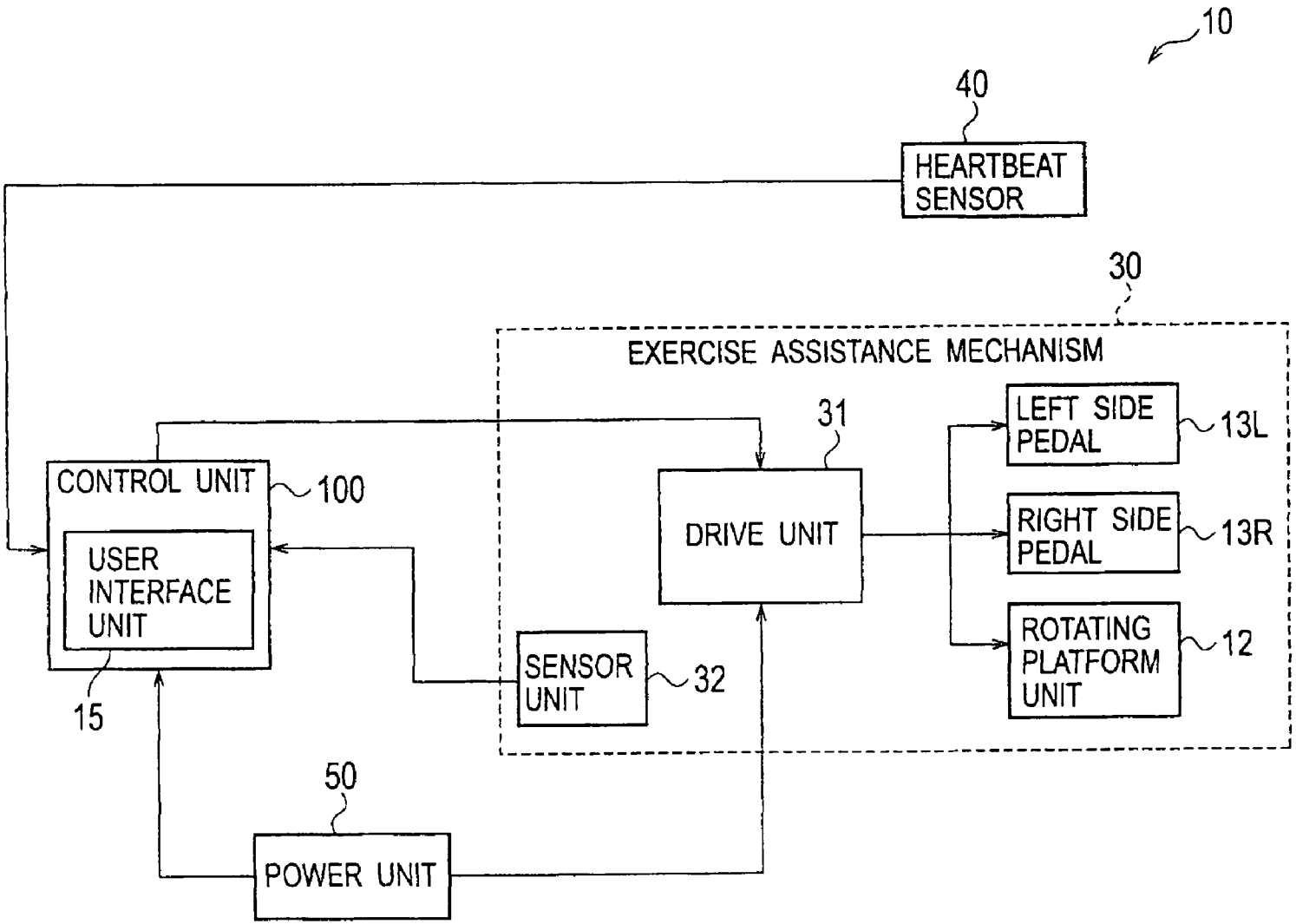
FIG. 2 is a functional block diagram of the passive-type exercising device according to the embodiment.

FIG. 1 is an overall general configuration diagram of a passive-type exercising device 10 according to an embodiment of the invention. FIG. 2 is a functional block diagram of the passive-type exercising device 10.

As shown in FIG. 1, the passive-type exercising device 10 is a passive-type twist and step system exercising device capable of simultaneously performing twist exercise in which a user twists one's entire body and step exercise in which the user runs on the spot.

The passive-type exercising device 10 includes a base unit 11 and a rotating platform unit 12 rotatably supported by the base unit 11. The rotating platform unit 12 turns in the directions of D1 and D2 by a drive force of a drive unit 31 (see FIG. 2).

A left side pedal 13L on which the user's left foot is placed and a right side pedal 13R on which the user's right foot is placed are provided on top of the rotating platform 12. The left side pedal 13L and the right side pedal 13R move upward and downward alternately by the drive force generated by the drive unit 31 (not shown in FIG. 1; see FIG. 2). More specifically, when the left side pedal 13L moves upward, the right side pedal 13R moves downward, whereas when the left side pedal 13L moves downward, the right side pedal 13R moves upward.

Further, the vertical movements of the left side pedal 13L and the right side pedal 13R are coordinated with the rotation of the rotating platform unit 12. In other words, when the rotating platform unit 12 turns in the D1 direction, the right side pedal 13R moves downward, whereas when the rotating platform unit 12 turns in the D2 direction, the left side pedal 13L moves downward.

The speed of the vertical movements of the left side pedal 13L and the right side pedal 13R and the speed of rotation of the rotating platform unit 12 will be called collectively as "operation speed of the exercise assistance mechanism 10*a*" below. Further, the number of vertical movements of the left side pedal 13L and the right side pedal 13R will be called arbitrarily as a "number of steps".

As such, the user can perform the twist exercise and the step exercise at the same time while receiving an assistance by the passive-type exercising device 10 with the rotation of the rotating platform unit 12 and the vertical movements of the left side pedal 13L and the right side pedal 13R. In this embodiment, the drive unit 31, the rotating platform 12, the left side pedal 13L, and the right side pedal 13R constitute the exercise assistance mechanism 10*a* for assisting exercise of the user while applying an exercising load to the user.

A support unit 14 is connected to the passive-type exercising device 10. The support unit 14 extends upward from an edge of the base unit 11 and supports a user interface unit 15 and a handle 16. The support unit 14 is foldably configured.

The user interface unit 15 is provided at the upper end of the support unit 14 and functions as interface with the user. The handle 16 is to be gripped by the user.

As shown in FIG. 2, the passive-type exercising device 10 includes a control device 100 for controlling the exercise assistance mechanism 10*a*. The control device 100 is composed of a CPU and a memory.

The passive-type exercising device 10 includes a heartbeat sensor 40 for detecting the user's heartbeat. The heartbeat sensor 40 transmits the detected heartbeat to the control device 100 as electrical signals. As the heartbeat sensor 40, for example a clip-type heartbeat sensor worn on the user's ear lobe may be adopted.

The exercise assistance mechanism 10*a* includes the drive unit 31 for driving the rotating platform unit 12, the left side pedal 13L, and the right side pedal 13R. The drive unit 31 is composed for example of a motor or a power transmission system.

The exercise assistance mechanism 10*a* includes a sensor unit 32 for detecting a physical value associated with the exercise assistance mechanism 10*a*. The sensor unit 32 outputs a sensor value indicating an operation intensity of the exercise assistance mechanism 10*a*. As the sensor unit 32, for example a potentiometer or a rotary encoder mounted on a motor at the drive unit 31 for detecting the rotation frequency (revolving speed) of the motor may be used.

Electric power is supplied to the control device 100 and the drive unit 31 from a power unit 50 provided at the passive-type exercising device 10.

(2) Configuration of the Control Device

Next, a configuration of the control device 100 will be explained by referring to FIGS. 3 to 6. In particular, (2.1) configuration of the control device, (2.2) configuration of the exercise intensity derivation unit, (2.3) configuration example of the input unit, and (2.4) configuration example of the display unit will be explained.

(2.1) Configuration of the Control Device

Figure 3:
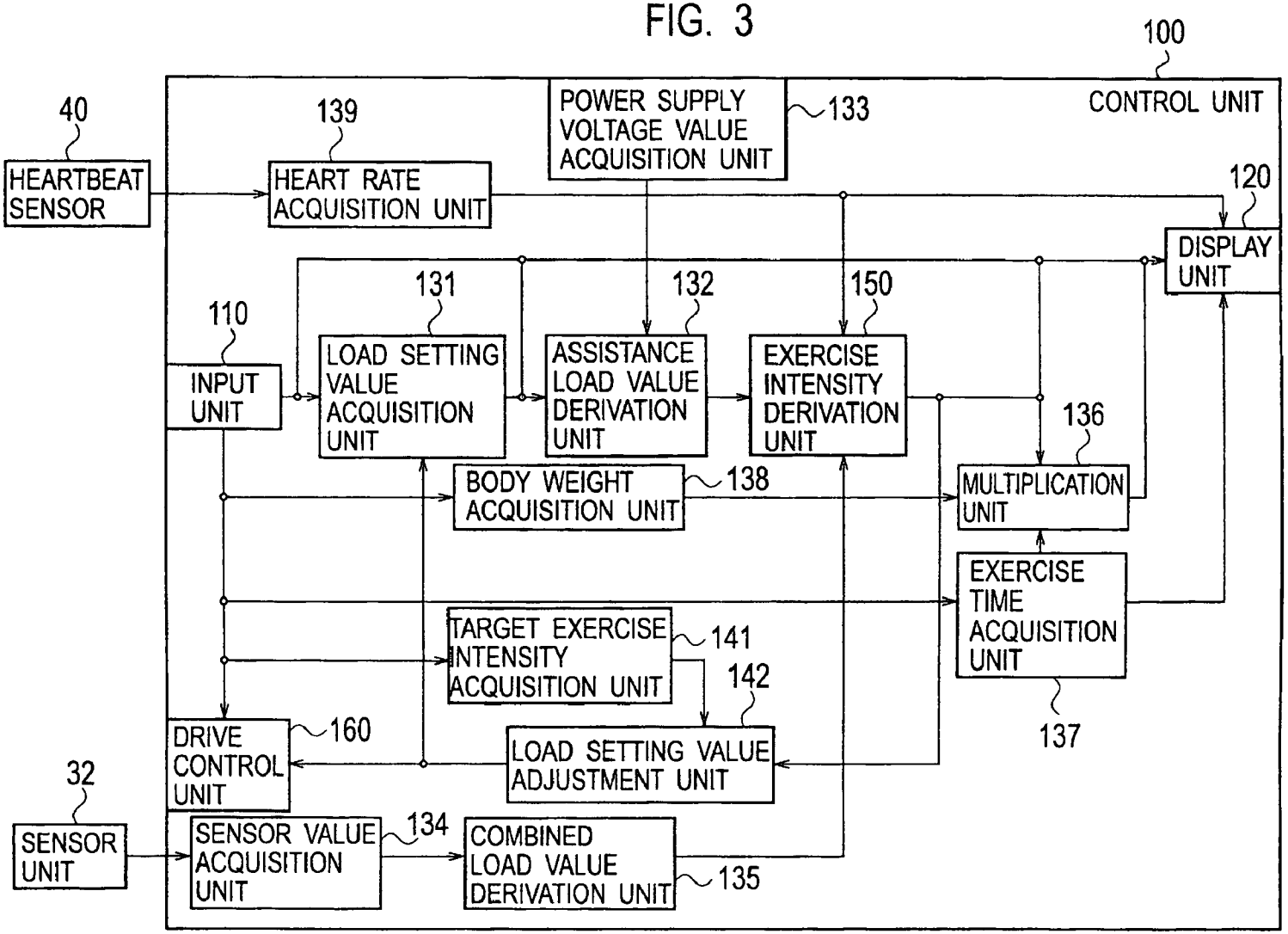
FIG. 3 is a functional block diagram of the control device according to the embodiment.

FIG. 3 is a functional block diagram of the control device 100. As shown in FIG. 3, the control device 100 includes an input unit 110 and a display unit 120 which constitute the user interface unit 15. The input unit 110 is composed of various buttons and receives inputs from the user. The display unit 120 is composed of a display for displaying various types of information.

The control device 100 includes a load setting value acquisition unit 131, an assistance load value derivation unit 132, a sensor value acquisition unit 134, a combined load value acquisition unit 135, and an exercise intensity derivation unit 150.

The load setting value acquisition unit 131 obtains a load setting value that is a setting value for the amplitude of the exercise load applied to the user by the exercise assistance mechanism 10*a*. In this embodiment, the load setting value is automatically adjustable by the control device 100.

The assistance load value derivation unit 132 derives an assistance load value that indicates amplitude of the user's exercising load that is reduced by the assistance of the exercise assistance mechanism 10*a* to the user's exercise.

The sensor value acquisition unit 134 obtains a sensor value indicating an operation intensity of the exercise assistance mechanism 10*a* outputted by the sensor unit 32 provided at the exercise assistance mechanism 10*a*. By obtaining the operation intensity of the exercise assistance mechanism 10*a*, it is possible to obtain a combined load value, which will be described below, which is because the actual operations of the exercise assistance mechanism 10*a* such as the speed, the acceleration, and the pressure change by being affected by both the exercising load applied to the user and the assisted load to the user's exercise.

The combined load value derivation unit 135 derives a combined load value which is a combined value of the assistance load value and the effective load value indicating the amplitude of the exercising load actually applied to the user, based on the sensor value obtained at the sensor value acquisition unit 134. In this embodiment, the combined load value is a value corresponding to the actual measurement of the operation speed of the exercise assistance mechanism 10*a*.

In other words, the combined load value, the assistance load value, and the effective load value have the following relationship amongst each other.

$$\text{Combined load value}=\text{Assistance load value}+\text{Effective load value}\quad \text{Effective load value}=\text{Combined load value}-\text{Assistance load value} \tag{1}$$

The exercise intensity derivation unit 150 derives the exercise intensity (METs) indicating an intensity of the user's exercise based on the effective load value computed as a difference between the assistance load value derived at the assistance load value derivation unit 132 and the combined load value derived at the combined load value derivation unit 135. Here, the exercise intensity (METs) increases in proportion to an increase of the effective load value, and therefore, from the effective load value it is possible to compute the exercise intensity easily.

The control device 100 further includes an exercise time acquisition unit 137, a body weight acquisition unit 138, and a multiplication unit 136. The multiplication unit 136 multiplies the exercise intensity (METs) derived at the exercise intensity derivation unit 150 and the exercise time obtained at the exercise time acquisition unit 137. In other words, the multiplication unit 136 computes Ekusasaizu (Ex) indicating the amount of exercise of the user according to the following formula (2).

$$\text{Amount of exercise Ekusasaizu Ex (METs}\cdot\text{hour)}=\text{Exercise intensity METs}\times\text{Exercise time (hour)} \tag{2}$$

The multiplication unit 136 also multiplies the exercise intensity derived at the exercise intensity derivation unit 150, the exercise time obtained at the exercise time acquisition unit 137, the body weight obtained at the body weight acquisition unit 138, and a predetermined coefficient (more specifically 1.05).

The multiplication unit 136 computes a calorie consumption amount (kcal) indicating an energy consumed by the user in accordance with the following formula (3) from the above multiplication. Here, Ekusasaizu Ex obtained by the formula (2) will be used.

$$\text{Calorie consumption amount (kcal)}=1.05\times\text{Ekusasaizu Ex (METs}\cdot\text{hour)}\times\text{Body weight (kg)} \tag{3}$$

The coefficient "1.05" in the formula (3) was derived because the calorie consumption amount "1 kcal"=oxygen uptake "200 ml" and 1 MET is 210 ml/kg/h.

The control device 100 includes a power supply voltage value acquisition unit 133 that obtains a power supply voltage value of the power unit 50. The assistance load value derivation unit 132 corrects the assistance load value in accordance with the change of the power supply voltage value obtained at the power supply voltage value acquisition unit 133.

The control device 100 further includes a target exercise intensity acquisition unit 141 and a load setting value adjustment unit 142. The target exercise intensity acquisition unit 141 obtains a target exercise intensity that is a goal value for the user's exercise intensity. The target exercise intensity is determined for example by an input by the user to the input unit 110.

The load setting value adjustment unit 142 automatically adjusts the load setting value depending on the comparison result of the target exercise intensity obtained at the target exercise intensity acquisition unit 141 and the exercise intensity derived at the exercise intensity derivation unit 150. The load setting value can be arbitrarily set by the user.

The control device 100 includes a heart rate acquisition unit 139 for obtaining the user's heart rate from the heartbeat detected by the heartbeat sensor 40, and a drive control unit 160 for controlling the drive unit 31.

The drive control unit 160 controls the drive force generated by the drive unit 31 (that is the operation speed of the exercise assistance mechanism 10*a*) etc. depending on the load setting value entered by the user at the input unit 110 or the load setting value adjusted by the load setting value adjustment unit 142.

In addition, the load setting value adjustment unit 142 and the drive control unit 160 function as an operation abort unit for forcibly stopping operations of the exercise assistance mechanism 10*a* when the difference between the target exercise intensity obtained at the target exercise intensity acquisition unit 141 and the exercise intensity derived at the exercise intensity derivation unit 150 exceeds a predetermined value.

(2.2) Configuration of the Exercise Intensity Derivation Unit

Figure 4:
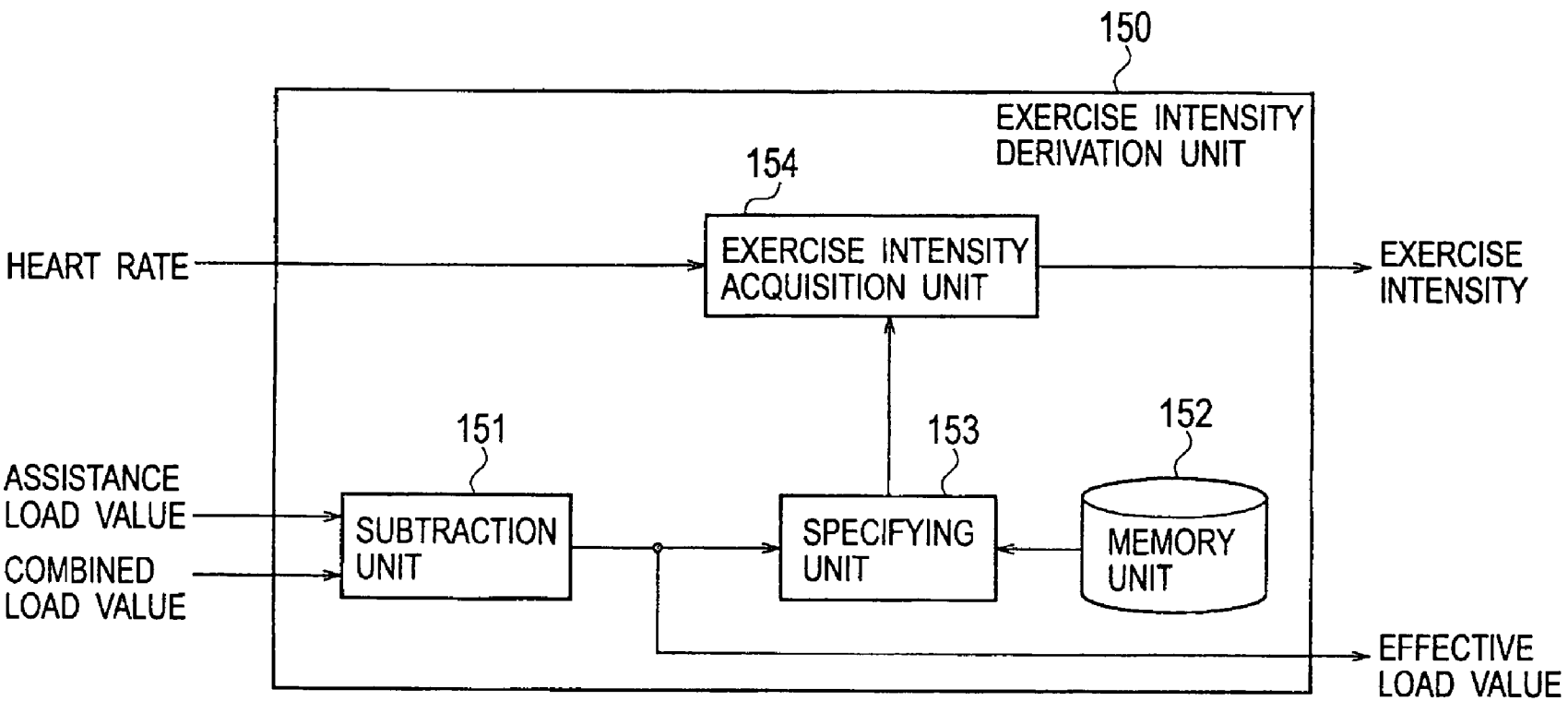
FIG. 4 is a functional block diagram of the exercise intensity derivation unit 150 according to the embodiment.

FIG. 4 is a functional block diagram of the exercise intensity derivation unit 150. As shown in FIG. 4, the exercise intensity derivation unit 150 includes a subtraction unit 151, a memory unit 152, a specifying unit 153, and an exercise intensity acquisition unit 154.

The subtraction unit 151 computes the effective load value by subtracting the assistance load value derived at the assistance load value derivation unit 132 from the combined load value derived at the combined load value derivation unit 135.

The memory unit 152 stores in advance a plurality sets of correspondence relationship information defining the relationships between the user's heart rate and the exercise intensity for different amplitudes of the exercise intensity.

The specifying unit 153 specifies the correspondence relationship information corresponding to the effective load value computed at the subtraction unit 151 from among the plurality sets of correspondence relationship information stored at the memory unit 152.

The exercise intensity acquisition unit 154 obtains the exercise intensity corresponding to the heart rate obtained at the heart rate acquisition unit 139 by referring to the correspondence relationship information specified by the specifying unit 153.

(2.3) Configuration Example of the Input Unit

Figure 5:
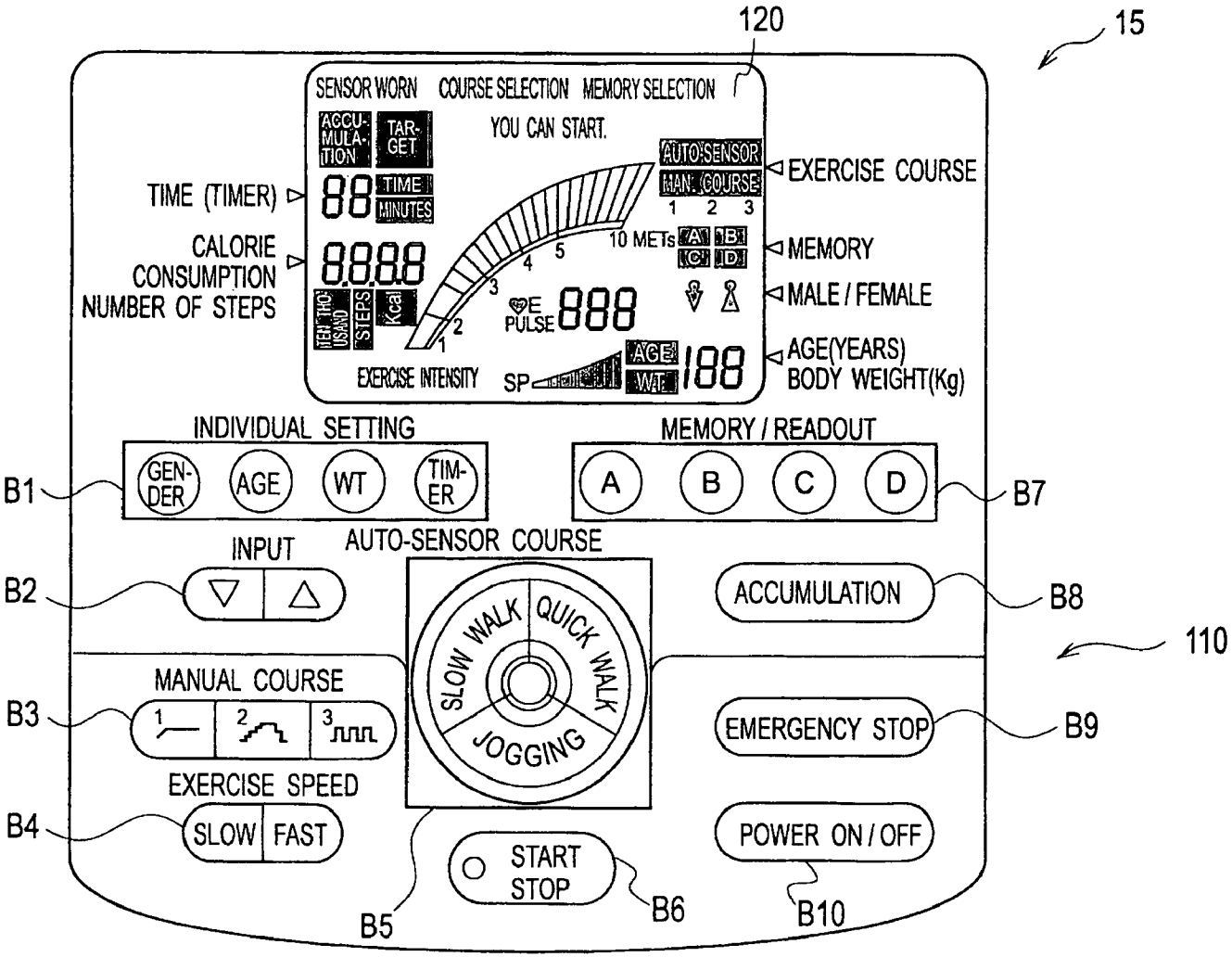
FIG. 5 is a front view showing a configuration of the input unit according to the embodiment.

FIG. 5 is a front view showing a configuration example of the input unit 110. As shown in FIG. 5, the input unit 110 includes an individual setting button B1, an input button B2, a manual course button B3, an exercise speed button B4, an auto-sensor course button B5, a start/stop button B6, a memory/readout button B7, an accumulation button B8, an emergency stop button B9, and a power on/off button B10. Here, the buttons relevant to the invention will be explained in detail.

The individual setting button B1 and the input button B2 are buttons used for an input and setting of the individual information such as the user's gender, age, and weight.

The manual course button B3 is a button for selecting a type of the manual courses for performing a predetermined exercise.

The exercise speed button B4 is a button for setting the operation speed of the exercise assistance mechanism la at the manual course. In other words, in this embodiment the user uses the exercise speed button B4 to enter the load setting value.

The auto-sensor course button B5 is a button for selecting a type of the auto-sensor course. At the auto-sensor course, the load setting value or the operation speed of the exercise assistance mechanism 10*a* is automatically adjusted based on the heartbeat detected by the heartbeat sensor 40. Here, the types of the auto-sensor course are set for different exercise intensities. In other words, the user uses the exercise speed button B4 to enter the target exercise intensity.

As an example, at the auto-sensor course, slow walk that corresponds to the exercise intensity equivalent to 3 METs, quick walk that corresponds to the exercise intensity equivalent to 4 METs, and jogging that corresponds to the exercise intensity equivalent to 5 METs are being set up.

The memory/readout button B7 is a button for selecting and reading out individual information stored in advance.

(2.4) Configuration Example of the Display Unit

Figure 6:
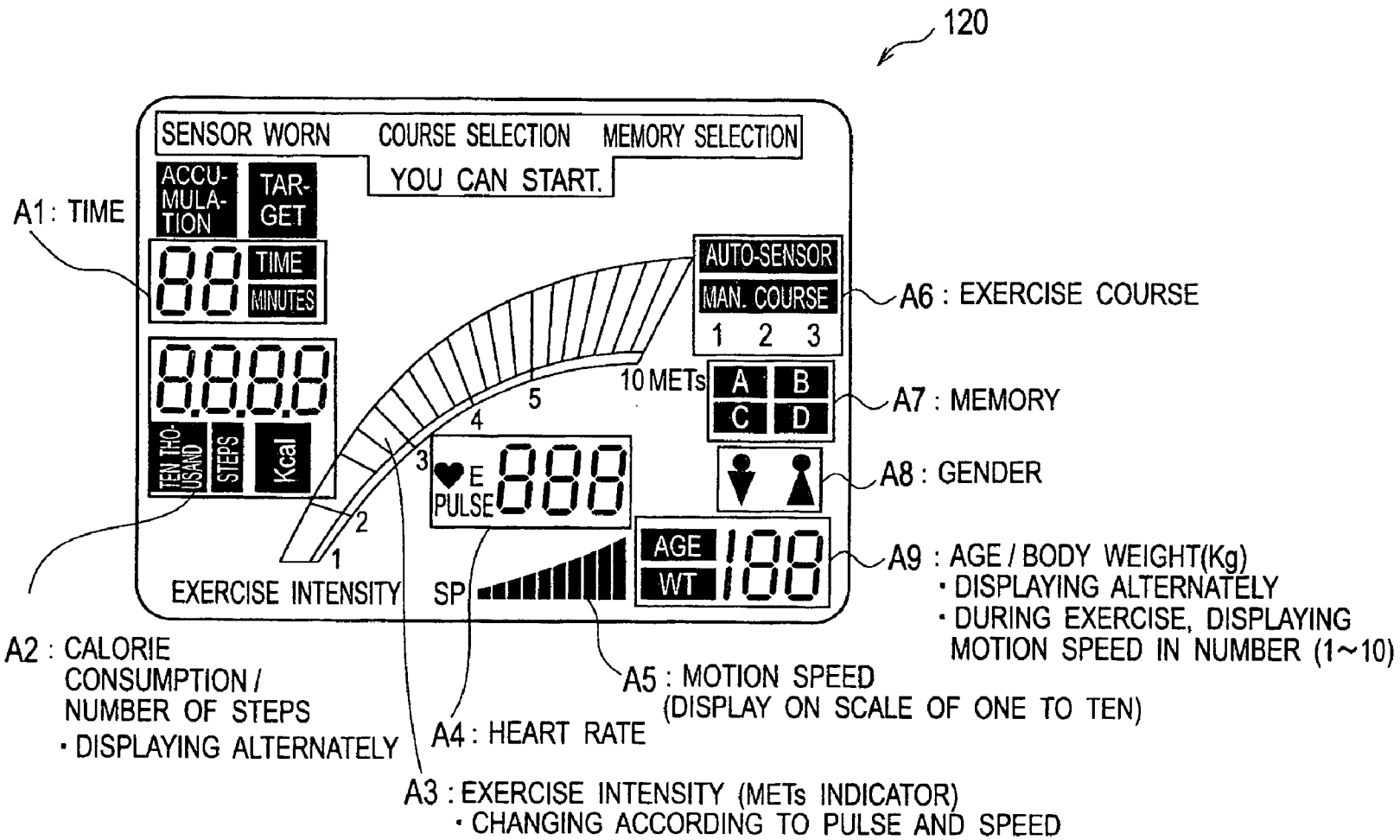
FIG. 6 is a front view showing a configuration of the display unit according to the embodiment.

FIG. 6 is a front view showing a configuration example of the display unit 120. As shown in FIG. 6, the display unit 120 includes a time display area A1, a calorie consumption/number of steps display area A2, an exercise intensity display area A3, a heart rate display area A4, an operation speed display area A5, an exercise course display area A6, a memory display area A7, a gender display area A8, and an age/body weight display area A9. Here, the display areas that are relevant to the invention will be explained in detail.

The time display area A1 is an area for displaying the user's exercise time. The exercise time is obtained or measured at the exercise time acquisition unit 137.

The calorie consumption/number of steps display area A2 is an area for alternately displaying the user's calorie consumption amount and the number of steps. The calorie consumption amount is computed at the multiplication unit 136 based on the exercise intensity.

The exercise intensity display area A3 is an area for displaying the user's exercise intensity (METs). In the example of FIG. 6, the exercise intensity is displayed in a band chart within the range of 1 MET to 10 METs. The exercise intensity is derived at the exercise intensity derivation unit 150. The exercise intensity display area A3 constitutes a notification unit for notifying the exercise intensity derived at the exercise intensity derivation unit 150 to the user.

The heart rate display area A4 is an area for displaying the user's heart rate. The heart rate is obtained or computed at the heart rate acquisition unit 139 based on the number of heartbeat per unit time.

The operation speed display area A5 is an area for displaying the operation speed (combined load value) of the exercise assistance mechanism 10*a*. Alternatively, the operation speed display area A5 displays the effective load value computed as the difference between the assistance load value and the combined load value. In this embodiment, the combined load value or the effective load value is displayed in a band chart on a scale of one to ten.

The operation speed display area A5 constitutes a notification unit for notifying the effective load value to the user. Also, the operation speed display area A5 may perform a display based on a difference between the effective load value and a desired load value. Alternatively, it may perform a notification based on a difference between the exercise intensity corresponding to the effective load value and the exercise intensity corresponding to the desired load value.

Here, the desired load value is an effective load value at the time when the load setting value and the sensor value are equivalent; in other words it is an ideal exercise load to be achieved by the passive-type exercising device 10. More specifically, when the effective load value has not reached the desired load value, it shows that the user's active exercise is not enough, whereas when the effective load value exceeds the desired load value, it shows that the user's active exercise is too much.

The exercise course display area A6 is an area for displaying the selected exercise course. More specifically, it shows which of the auto-sensor course and the manual course is being performed.

The display unit 120 can display various types of information that will be described below, which is not limited to each display area as shown in FIG. 6.

(3) Derivation Processing of the Effective Load Value and the Exercise Intensity Next, derivation processing of the effective load value and the exercise intensity will be explained by referring to FIGS. 7 and 8.

(3.1) Derivation Processing of the Effective Load Value

FIGS. 7A to 7D are conceptual views for explaining the derivation processing of the effective load value.

Figure 7A:
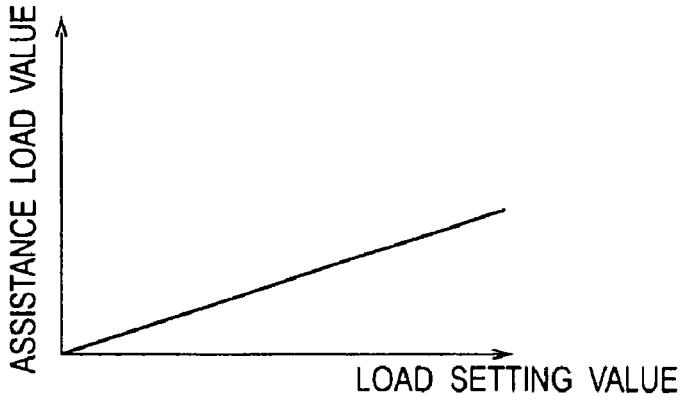
FIGS. 7A to 7D are conceptual diagrams for explaining derivation processing of the effective load value according to the embodiment.
Figure 7B:
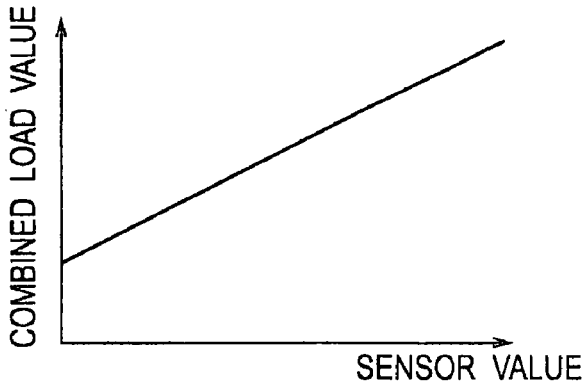

As shown in FIG. 7A, the assistance load value derivation unit 132 derives the assistance load value based on the load setting value obtained at the load setting value acquisition unit 131. The assistance load value increases in proportion to an increase of the load setting value. Thus, when the proportionality coefficient is K1, the assistance load value can be computed by the following formula (4).

$$\text{Assistance load value} = K1 \times \text{Load setting value} \quad (4)$$

Here, the proportionality coefficient K1 is determined from either a setup value of the assistance load value for each load setting value or an actual measurement value of the assistance load value measured in advance for each load setting value in a state that no one is mounted on the exercise assistance mechanism 10*a*.

Next, the combined load value derivation unit 135 derives the combined load value based on the sensor value obtained at the sensor value acquisition unit 134. As described above, the combined load value is a value that the assistance load value and the effective load value are combined. Here, with the effective load value, an energy consumption amount of the user under the resting conditions (basal metabolism) also is considered.

The combined load value increases as the sensor value increases. Therefore, when a proportionality coefficient is K2 and the exercise load of the basal metabolism part is A, the combined load value can be computed by the following formula (5).

$$\text{Combined load value} = K2 \times \text{Sensor value} + A \quad (5)$$

More specifically, the formula (5) can be obtained as follows. In particular, the relationships among the load setting value, the sensor value, and the exercise intensity are obtained from subject experiments such as of oxygen uptake measurements.

Provisionally, in a state that the load setting value and the sensor value are equal, a relational expression between the sensor value and the exercise intensity (effective exercise intensity) is determined as in the formula (6).

$$\text{Effective exercise intensity}=Km0\times\text{Sensor value}+Am \quad (6)$$

Here, Am is an exercise intensity of the basal metabolism part.

Next, a proportionality coefficient Km2 between the sensor value and the combined exercise intensity is determined.

$$\text{Effective exercise intensity}=Km2\times\text{Sensor value}+Am \quad (7)$$

Figure 7C:
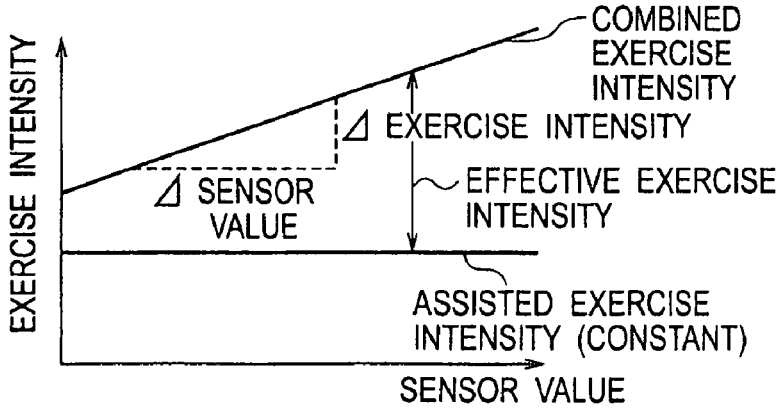

Here, the proportionality coefficient Km2 is determined as follows. As shown in FIG. 7C, when the load setting value is constant, the assisted exercise intensity is also constant, and thus, the amount of change for the combined exercise intensity resulting from the change of the sensor value is equal to the amount of change for the effective exercise intensity resulting from the change of the sensor value. Thus, the following formula (8) is true.

$$\Delta\ \text{Exercise intensity}=Km2\times\Delta\ \text{Sensor value} \quad (8)$$

From the formula (8), the proportionality coefficient Km2 is determined.

Next, when the load setting value and the sensor value are equal, the assisted exercise intensity=the combined exercise intensity−the effective exercise intensity, and when the difference between Km2 and Km0 is Km1 (Km1=Km2−Km0), the following formula (9) is true.

$$\text{Assisted exercise intensity}=Km1\times\text{Load setting value} \quad (9)$$

From the formula (4) and the formula (9), $$\text{When } K3=Km1/K1$$

$$K2=Km2/K3$$

$$A=Am/K3 \quad (10)$$

the formula (5) can be obtained.

Figure 7D:
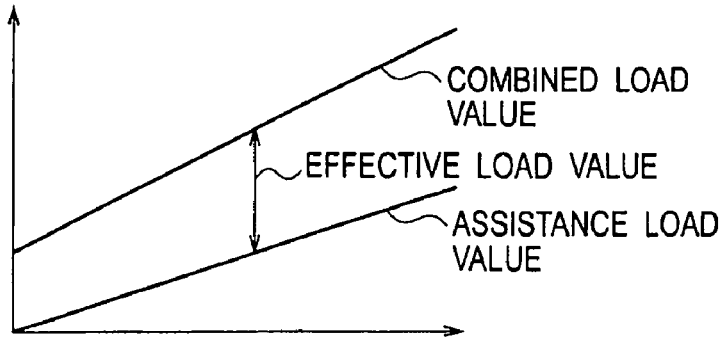

As shown in FIG. 7D, the subtraction unit 151 of the exercise intensity derivation unit 150 computes the effective load value by obtaining the difference between the combined load value derived at the combined load value derivation unit 135 and the assistance load value derived at the assistance load value derivation unit 132.

As such, by eliminating the degree of assistance to the user's exercise by the exercise assistance mechanism 10*a* (the assistance load value), the degree of active exercise by the user (the effective load value) can be obtained.

(3.2) Derivation Processing of the Exercise Intensity

Figure 8A:
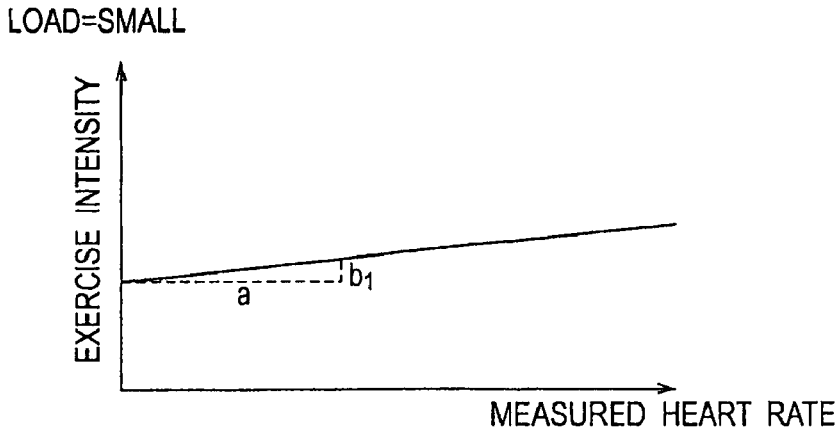
FIGS. 8A to 8C are conceptual diagrams for explaining derivation processing of the control device according to the embodiment.
Figure 8B:
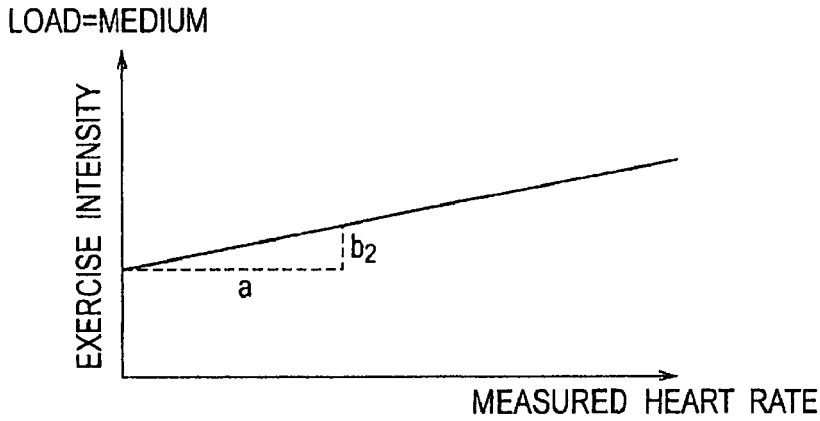
Figure 8C:
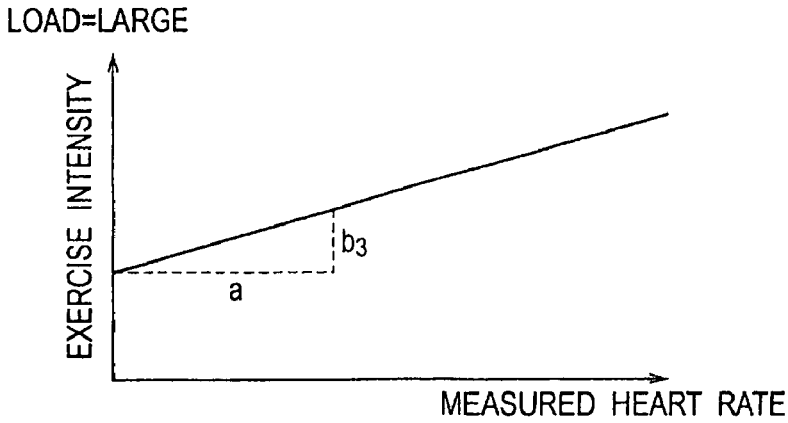

FIGS. 8A to 8C are conceptual views for explaining the derivation processing of the exercise intensity. As shown in FIGS. 8A to 8C, the memory unit 152 stores in advance a plurality sets of correspondence relationship information defining the relationships between the user's heart rate and the exercise intensity for different amplitudes of the exercise intensity. In the examples of FIGS. 8A to 8C, three kinds of cases in which the amplitudes of the exercise loads are "large", "medium" and "small" will be illustrated to simplify the explanation.

FIG. 8A is a graph showing the relationship between the user's heart rate (measured heart rate) and the user's exercise intensity when the load is "small". FIG. 8B is a graph showing the relationship between the user's heart rate (measured heart rate) and the user's exercise intensity when the load is "medium". FIG. 8C is a graph showing the relationship between the user's heart rate (measured heart rate) and the user's exercise intensity when the load is "large".

As shown in FIGS. 8A to 8C, the smaller the load is, the smaller the increased amount for the user's exercise intensity with the increase in the user's heart rate (b/a) becomes. In other words, the relationship "$b_1$/a" (the load="small")<"$b_2$/a" (the load="medium")<"$b_3$/a" (the load="large") is true.

The specifying unit 153 specifies the correspondence relationship information that corresponds to the effective load value computed at the subtraction unit 151 from among the plurality sets of correspondence relationship information stored in the memory unit 152.

The exercise intensity acquisition unit 154 obtains the exercise intensity that corresponds to the heart rate obtained at the heart rate acquisition unit by referring to the correspondence relationship information specified by the specifying unit 153.

It is known that in a case that the user's heart rate is relatively low (such as in a case in which the heart rate is less than 100), the influence of the user's psychological component being exerted on the heart rate is large. Also, the user's heart rate is supposed to be relatively low when the exercise load is small.

Therefore, as shown in FIGS. 8A to 8C, it is made such that the increase of the user's exercise intensity with the increase of the user's heart rate is less in a case that the user's heart rate is supposed to be relatively low.

Therefore, even when the heart rate changes due to the user's psychological element, the user's exercise intensity is insusceptible to such changes and thus it is possible to derive the user's exercise intensity more accurately.

(4) Operation of the Control Device

Next, by referring to FIGS. 9 to 13, operations of the control device 100, in particular, (4.1) overall operations of the control device, (4.2) derivation operations of the exercise intensity, (4.3) shortfall/excess notification operation, (4.4) adjustment operations of the load setting value, and (4.5) adjustment operations of the assistance load value will be explained.

(4.1) Overall Operations of the Control Device

Figure 9:
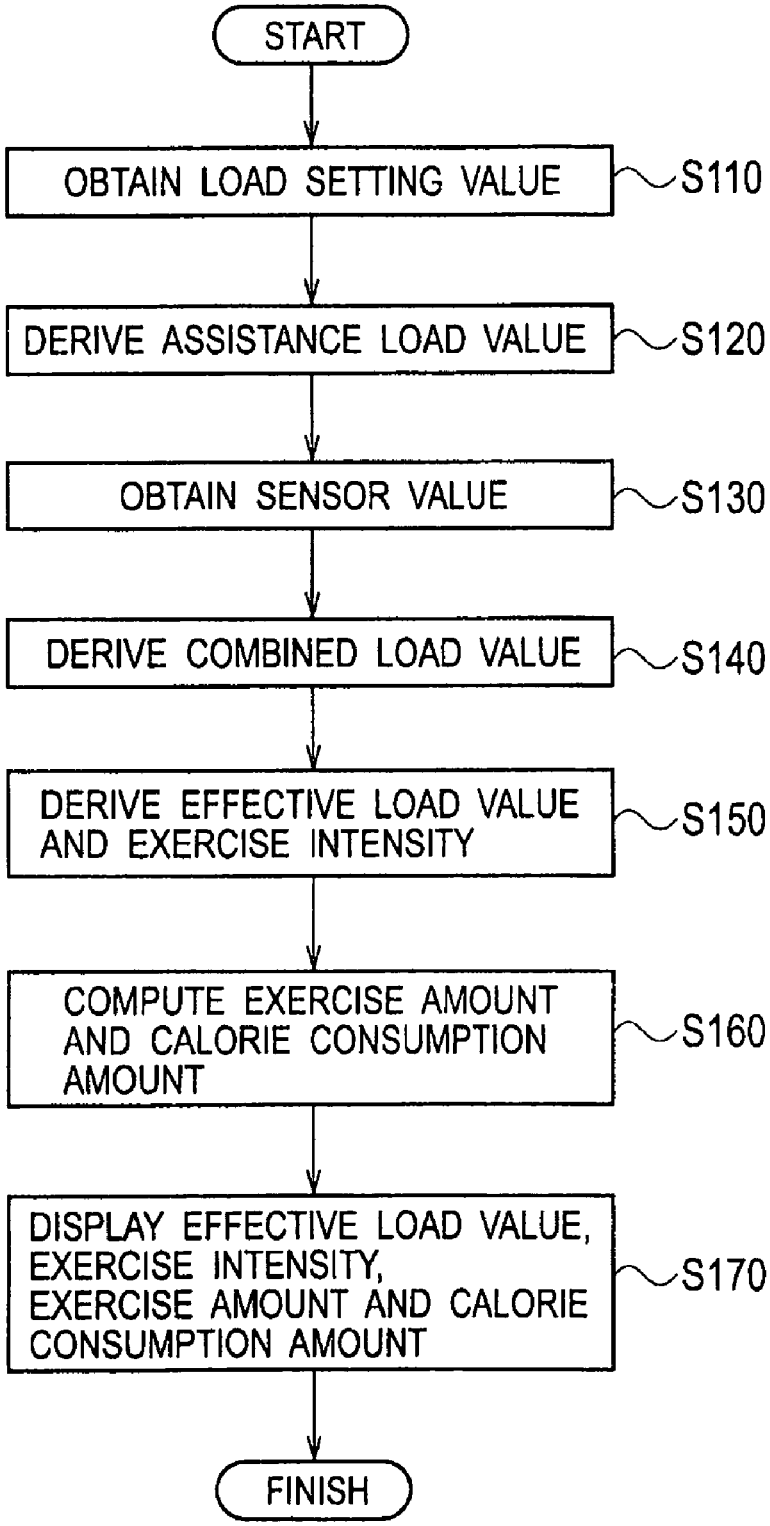
FIG. 9 is a flowchart showing the overall operations of the control device according to the embodiment.

FIG. 9 is a flowchart showing the overall operations of the control device 100.

At step S110, at the manual course, the load setting value acquisition unit 131 obtains a value entered by the user at the exercise speed button B4 as the load setting value. At the auto-sensor course, the load setting value acquisition unit 131 obtains the load setting value automatically changed and set by the load setting value adjustment unit 142.

At step S120, the assistance load value derivation unit 132 computes the assistance load value from the load setting value obtained at step S110 using the formula (4).

At step S130, the sensor value acquisition unit 134 obtains the sensor value (actual measurement value of the operation speed of the exercise assistance mechanism 10*a*).

At step S140, the combined load value derivation unit 135 computes the combined load value from the sensor value obtained at step S130 using the formula (5).

At step S150, the exercise intensity derivation unit 150 computes the effective load value by subtracting the assistance load value from the computed combined load value. Further, the exercise intensity derivation unit 150 derives the exercise intensity from the computed effective load value.

At step S160, the multiplication unit 136 computes the amount of exercise (Ekusasaizu Ex) and the calorie consumption amount of the user by using the formula (2) and the formula (3).

At step S170, the display unit 120 displays the effective load value, the exercise intensity, the amount of exercise (Ekusasaizu Ex), and the calorie consumption amount.

(4.2) Derivation Operations of the Exercise Intensity

Figure 10:
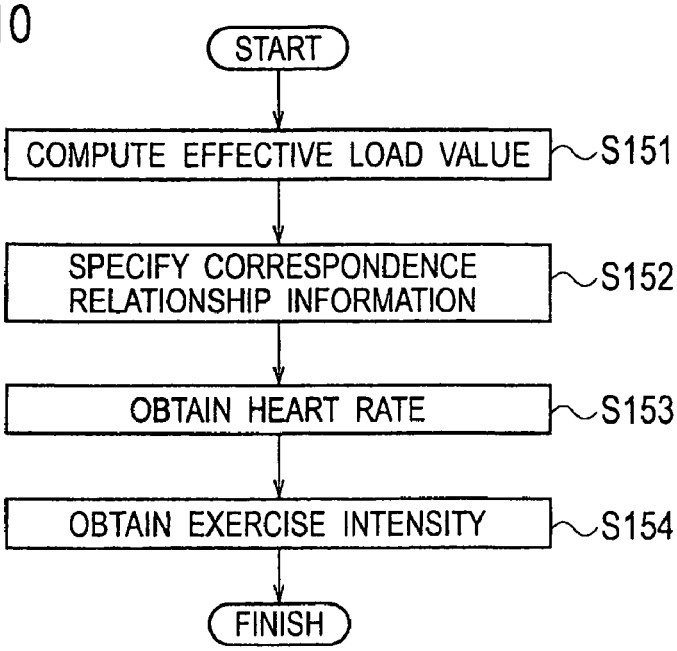
FIG. 10 is a flowchart showing derivation operations of the exercise intensity according to the embodiment.

FIG. 10 is a flowchart showing derivation operations of the exercise intensity.

At step S151, the subtraction unit 151 computes the effective load value.

At step S152, the specifying unit 153 specifies the corresponding relationship information that corresponds to the effective load value computed at the subtraction unit 151 from the plurality sets of corresponding relationship information stored in the memory unit 152.

At step S153, the heart rate acquisition unit 139 obtains the user's heart rate from the heartbeat detected by the heartbeat sensor 40.

At step S154, the exercise intensity acquisition unit 154 obtains the exercise intensity that corresponds to the heart rate obtained at the heart rate acquisition unit 139 by referring to the corresponding relationship information specified by the specifying unit 153.

(4.3) Shortfall/Excess Notification Operations

Figure 11:
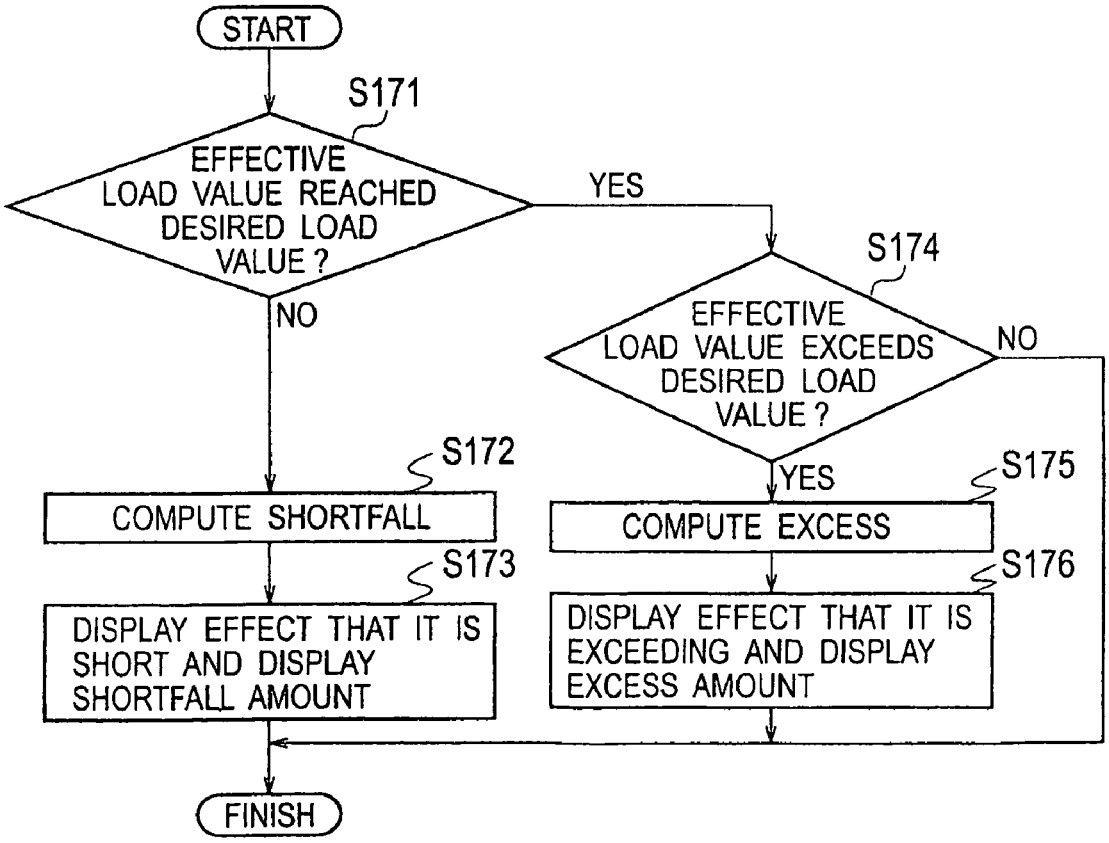
FIG. 11 is a flowchart showing shortfall/excess notification operations performed by the display unit according to the embodiment.

FIG. 11 is a flowchart showing shortfall/excess notification operations carried out by the display unit 120.

At step S171, the display unit 120 determines whether or not the effective load value has reached a desired load value. If the effective load value has not reached the desired load value, the process advances to step S172. If the effective load value has reached the desired load value, the process advances to step S174.

At step S172, the display unit 120 computes the shortfall of the effective load value by subtracting the effective load value from the desired load value.

At step S173, the display unit 120 displays the effect that the effective load value has not reached the desired load value and displays the computed shortfall.

On the other hand, at step S174, the display unit 120 determines whether or not the effective load value exceeds the desired load value. If the effective load value exceeds the desired load value, the process advances to step S175.

At step S175, the display unit 120 computes the excess of the effective load value by subtracting the desired load value from the effective load value.

At step S176, the display unit 120 displays the effect that the effective load value exceeds the desired load value and displays the computed excess amount.

While the display or notification in accordance with the difference between the effective load value and the desired load value is carried out in FIG. 11, it also is possible to display or notify in accordance with the difference in the exercise intensity corresponding to the effective load value and the exercise intensity corresponding to the desired load value.

(4.4) Adjustment Operations of the Load Setting Value

Figure 12:
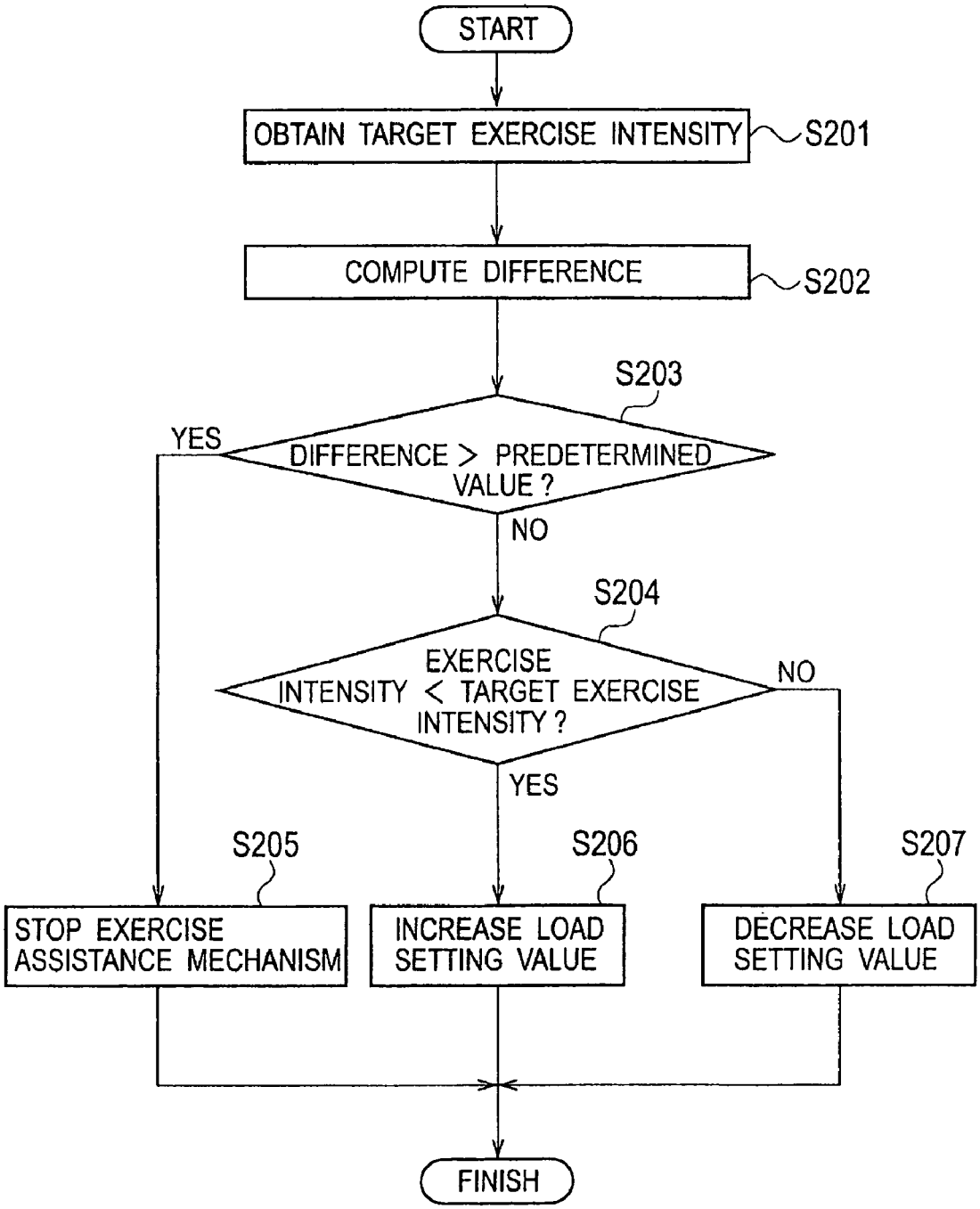
FIG. 12 is a flowchart showing changing operations of the load setting value according to the embodiment.

FIG. 12 is a flowchart showing changing operations of the load setting value.

At step S201, the target exercise intensity acquisition unit 141 obtains a target exercise intensity such as 3 METs, 4 METs, or 5 METs.

At step S202, the load setting value adjustment unit 142 computes a difference between the target exercise intensity obtained at the target exercise intensity acquisition unit 141 and the exercise intensity derived at the exercise intensity derivation unit 150.

At step S203, the load setting value adjustment unit 142 determines whether or not the difference computed at step S202 exceeds a predetermined value. If the difference exceeds the predetermined value, the drive control unit 160 stops the operations of the exercise assistance mechanism 10*a* at step S205.

At step S204, the load setting value adjustment unit 142 determines whether or not the exercise intensity derived at the exercise intensity derivation unit 150 exceeds or falls below the target exercise intensity obtained at the target exercise intensity acquisition unit 141.

When the derived exercise intensity falls below the target exercise intensity, the load setting value adjustment unit 142 increases the load setting value at step S206.

On the other hand, when the derived exercise intensity exceeds the target exercise intensity, the load setting value adjustment unit 142 decreases the load setting value at step S207.

(4.5) Correction Operations of the Assistance Load Value

Figure 13:
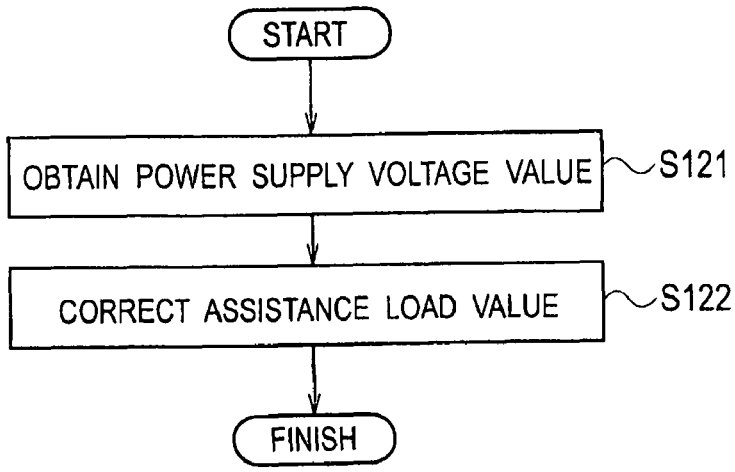
FIG. 13 is a flowchart showing correction operations of the assistance load value according to the embodiment.

FIG. 13 is a flowchart showing correction operations of the assistance load value.

At step S121, the power supply voltage value acquisition unit 133 obtains a power supply voltage value for the power unit 50.

At step S122, the assistance load value derivation unit 132 corrects the assistance load value in accordance with the fluctuation of the power supply voltage value obtained at the power supply voltage value acquisition unit 133.

More specifically, when the power supply voltage value fluctuates, the assistance load value fluctuates while the load setting value stays constant. The assistance load value derivation unit 132 decreases the assistance load value when the power supply voltage value decreases, and increases the assistance load value when the power supply voltage value increases.

(5) Operations and Effects

According to the embodiment, the assistance load value derivation unit 132 derives the assistance load value based on the load setting value that is a set value for the amplitude of the exercise load. Such an assistance load value reflects the part contributed by the exercise assistance mechanism 10*a* (assisted part) in the operation intensity of the exercise assistance mechanism 10*a*.

The combined load value derivation unit 135 derives the combined load value based on the sensor value indicating the operation intensity of the exercise assistance mechanism 10*a*, which is outputted by the sensor unit 32 provided at the exercise assistance mechanism 10*a*. Such a combined load value reflects an actual operation intensity for the exercise assistance mechanism 10*a*.

The exercise intensity derivation unit 150 derives the exercise intensity based on the effective load value computed as a difference between the assistance load value and the combined load value. The exercise intensity derivation unit 150 derives the exercise intensity (METs) based on the effective load value computed as the difference between the assistance load value and the combined load value. In other words, in the operation intensity of the exercise assistance mechanism 10*a*, the part remaining after the part contributed by the exercise assistance mechanism 10*a* (assisted part) is the exercising load actually applied to the user (effective load value).

For example, when the setup value for the exercise assistance mechanism 10*a* is to operate in the intensity (energy) of "5", and if the actual operation intensity (energy) obtained from the sensor unit 32 is "7", then it means the user is operating the exercise assistance mechanism 10*a* with the intensity (energy) of "2".

By deriving the exercise intensity (METs) from such an effective load value, it is possible to obtain an exercise intensity that accurately reflects the user's active exercise by removing the assisted part assisted by the exercise assistance mechanism 10*a*. Therefore, it is possible to provide the control device 100 and the passive-type exercising device 10 with improved accuracy in deriving the exercise intensity.

According to the embodiment, the specifying unit 153 specifies correspondence relationship information that corresponds to the effective load value computed at the subtraction unit 151 from among the plurality sets of correspondence relationship information defining the relationships between the user's heart rate and the exercise intensity for different amplitudes of the exercising loads. The exercise intensity acquisition unit 154 obtains the exercise intensity that corresponds to the heart rate obtained at the heart rate acquisition unit 139 by referring to the correspondence relationship information specified by the specifying unit 153.

Therefore, even in such a case that the load setting value or the assistance load value and the exercise intensity do not necessarily interlock with each other, the user's exercise intensity still can be derived accurately.

According to the invention, the display unit 120 displays the exercise intensity derived at the exercise intensity derivation unit 150 and the effective load value computed at the subtraction unit 151. Therefore, it is possible for the user to grasp the exercise intensity and the effective load value easily and thus exercising efficiency can be increased.

According to the invention, the display unit 120 performs a display in accordance with the difference between the effective load value and the desired load value, or a display in accordance with the exercise intensity corresponding to the effective load value and the exercise intensity corresponding to the desired load value. For example, when the effective load value has not reached the desired load value, the display unit 120 displays the effect that the effective load value has not reached the desired load value. From this, the user can strive to increase the effective load value by intensifying one's active exercise.

On the other hand, by decreasing the load setting value, the assistance load value also decreases and thus the combined load value (that is, the operation speed of the exercise assistance mechanism 10*a*) also decreases. In this case, the user can increase the effective load value by intensifying one's active exercising such that the combined load value (the operation speed of the exercise assistance mechanism 10*a*) does not decrease. Therefore, it is possible for the user to achieve a desired effective load value or desired exercise intensity while using the operation speed of one's choice for the exercise assistance mechanism 10*a*.

Further, when the effective load value exceeds the desired load value, the display unit 120 notifies the effect that the effective load value exceeded the desired load value. Therefore, the user can strive to lower the effective load value by weakening one's active exercise.

On the other hand, by increasing the load setting value, the assistance load value also increases, and thus the combined load value (that is, the operation speed of the exercise assistance mechanism 10*a*) also increases. In this case, the user can decrease the effective load value by weakening one's active exercising such that the combined load value (the operation speed of the exercise assistance mechanism 10*a*) does not increase. Therefore, it is possible for the user to achieve a desired effective load value or desired exercise intensity while using the operation speed of one's choice for the exercise assistance mechanism 10*a*.

According to the embodiment, the multiplication unit 136 computes the amount of exercise (Ekusasaizu Ex) by multiplying the exercise intensity and the exercise time. The computed amount of exercise (Ekusasaizu Ex) is displayed at the display unit 120 and as such the user can grasp the amount of exercise (Ekusasaizu Ex) easily.

According to the embodiment, the multiplication unit 136 computes the calorie consumption amount by multiplying the exercise intensity, the exercise time, the body weight, and the predetermined coefficient. The computed calorie consumption amount is displayed at the display unit 120 and as such the user can grasp the calorie consumption amount easily.

According to the embodiment, the load setting value adjustment unit 142 increases the load setting value when the exercise intensity derived from the exercise intensity derivation unit 150 falls below the target exercise intensity, and decreases the load setting value when the exercise intensity derived from the exercise intensity derivation unit 150 exceeds the target exercise intensity.

Therefore, not only that it is possible to provide notification to the user, but it also can automatically adjust the load setting value appropriately based on the exercise intensity (METs), thus enhancing the exercise efficiency for the user.

According to the embodiment, the load setting value adjustment unit 142 and the drive control unit 160 stops operations of the exercise assistance mechanism 10*a* when a difference between the exercise intensity derived at the exercise intensity derivation unit 150 and the target exercise intensity exceeds a predetermined value. Therefore, in such a case that an emergency stop is necessary or that it is necessary to stop excessive exercise by the user, the operations of the exercise assistance mechanism 10*a* can be automatically stopped.

According to the embodiment, the assistance load value derivation unit 132 corrects the assistance load value in accordance with the fluctuation of the voltage value obtained at the power supply voltage value acquisition unit 133. Thus, even when the power supply voltage value fluctuates, the assistance load value can be computed accurately.

(6) Other Embodiments

The invention was described above in accordance with the embodiment; however, the description and the drawings as part of this disclosure should not be considered as restrictive. From this disclosure, various alternative embodiments, examples and application techniques become evident for one of ordinary skill in the art.

In the above embodiment, the exercise intensity acquisition unit 154 of the exercise intensity derivation unit 150 obtained the exercise intensity corresponding to the heart rate obtained at the heart rate acquisition unit 139. However, the exercise intensity derivation unit 150 is not limited to the configuration in which the exercise intensity is derived from the heart rate, but it may also derive the exercise intensity of the user directly from the effective load value. In particular, the exercise intensity of the user increases in proportion to an increase of the effective load value, and therefore, it is possible to compute the exercise intensity by multiplying the effective load value and a coefficient K3.

Also, in the above embodiment, the assistance load value derivation unit 132 computed the assistance load value from the load setting value obtained at the load setting value acquisition unit 131 by using the formula (4). However, the assistance load value derivation unit 132 is not limited to the case in which the assistance load value is obtained by computation, and the assistance load value also may be derived from using a correspondence table of the load setting value and the assistance load value. Similarly, the combined load value derivation unit 135 may derive the combined load value by using a correspondence table of the sensor value and the combined load value rather than the computation.

Further, the assistance load value derivation unit 132 also may derive the assistance load value that is converted to the exercise intensity (METs). The combined load value derivation unit 135 may derive the combined load value that is converted to the exercise intensity (METs). From such a configuration, the exercise intensity derivation unit 150 can derive the effective load value directly as the user's exercise intensity.

In the above embodiment, the display unit 120 displayed the exercise intensity derived at the exercise intensity derivation unit 150 and the effective load value computed at the subtraction unit 151. However, a configuration in which only one of the exercise intensity and the effective load value is displayed or a configuration in which neither of them is displayed also is possible. Further, it also is possible to adopt a configuration in which at least one of the exercise intensity and the effective load value is notified to the user by audio.

In the above embodiment, the display unit 120 performed a display in accordance with the difference between the effective load value and the desired load value. However, it is not limited to such a display and it also may be a phonetic notification by a speaker.

In the above embodiment, the multiplication unit 136 computed the amount of exercise (Ekusasaizu Ex) by multiplying the exercise intensity and the exercise time. However, as long as it is a value obtained by multiplying at least the exercise intensity and the exercise time, it is not limited to a case in which the amount of exercise (Ekusasaizu Ex) is obtained.

Similarly, the multiplication unit 136 computed the calorie consumption amount by multiplying the exercise intensity, the exercise time, the body weight, and the predetermined coefficient. However, as long as it is a value obtained by multiplying at least the exercise intensity, the exercise time, the body weight, and the predetermined coefficient, it is not limited to a case in which the calorie consumption amount is obtained. The user's body weight may also be obtained for example from a scale provided at the passive-type exercising device 10.

In the above embodiment, the load setting value adjustment unit 142 increased the load setting value when the exercise intensity derived at the exercise intensity derivation unit 150 falls below the target exercise intensity, and decreased the load setting value when the exercise intensity derived at the exercise intensity derivation unit 150 exceeds the target exercise intensity.

However, the load setting value adjustment unit 142 also may decrease the load setting value when the exercise intensity derived at the exercise intensity derivation unit 150 falls below the target exercise intensity and increase the load setting value when the exercise intensity derived at the exercise intensity derivation unit 150 exceeds the target exercise intensity. Alternatively, it is not limited to the auto-setting of the load setting value based on such exercise intensity, and it also may adopt auto-setting of the load setting value based on the heart rate.

The sensor unit 32 is not limited to detecting the number of motor revolutions, and it may also detect the operation speed, operation acceleration, weight, or pressure of the rotating platform unit 12, left side pedal 13L and the right side pedal 13R.

In the above embodiment, the assistance load value derivation unit 132 corrected the assistance load value in accordance with the fluctuation of the voltage value obtained at the power supply voltage value acquisition unit 133. However, it is not necessarily need to correct the assistance load value.

In the above embodiment, an explanation was made using an example of the twist and step system passive-type exercising device 10. However, the control device 100 is applicable to other types of passive-type exercising devices. For example, the control device 100 also may be applied to a passive-type exercising device having a system in which a seat oscillates simulating horseback riding. In this case, the oscillating seat corresponds to the exercise assistance mechanism.

In the above embodiment, as shown in FIGS. 8A to 8C, the correspondence relationship information is a graph indicating a relationship between the user's heart rate and the user's exercise intensity. However, it is not limited to such information.

Figure 14:
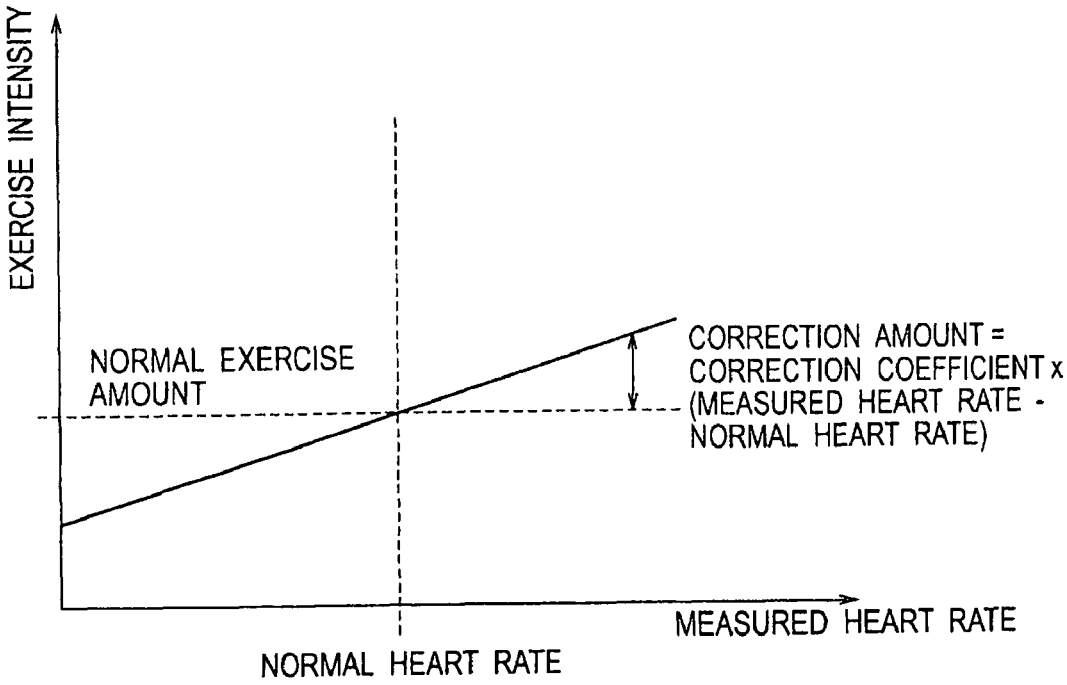
FIG. 14 is a view for explaining correspondence relationship information according to another embodiment of the invention.

For example, the correspondence relationship information also may be normal exercise intensity, normal heart rate, and correction coefficient as shown in FIG. 14. Here, the normal exercise intensity, the normal heart rate, and the correction coefficient are set for each load of the passive-type exercising device. The normal exercise intensity, the normal heart rate, and the correction coefficient also may be set for each of the individual information for the users.

In particular, the user's exercise intensity using the passive-type exercising device 10 is computed by the following formula (6).

$$\text{Exercise intensity (METs)} = \text{Normal exercise intensity (METs)} + \{\text{Correction coefficient} \times (\text{Measured heart rate (bpm; beats per minute)} - \text{Normal heart rate (bpm; beats per minute)})\} \quad (6)$$

Here, the normal exercise intensity, the normal heart rate, and the correction coefficient may be determined by subject experiments. For example, the subject experiments are performed as follows.

(1) Grouping subjects in accordance with the athletic abilities such as the body weight and gender.

(2) Having the grouped subjects use the passive-type exercising device using various loads.

(3) Measuring the exercise intensity and the heart rate in the above (2) and determining the normal exercise intensity, the normal heart rate, and the correction coefficient.

The present invention may be embodied in other specific forms without departing from the spirit or essential characteristics thereof. The embodiments are therefore to be considered in all respects as illustrative and not restrictive, the scope of the present invention being indicated by the appended claims rather than by the foregoing description, and all changes that come within the meaning and range of equivalency of the claims therefore are intended to be embraced therein.

What is claimed is:

1. A passive-type exercising device having an exercise assistance mechanism for assisting exercise of a user as well as applying an exercising load to the user by operating in a predetermined operation pattern, comprising:

a load setting value acquisition unit for obtaining a load setting value which is a setting value for amplitude of the exercising load applied to the user by the exercise assistance mechanism;

an assistance load value derivation unit for deriving an assistance load value indicating amplitude of the exercising load reduced by the exercise assistance mechanism's assisting the exercise of the user;

a sensor provided at the exercise assistance mechanism;

a sensor value acquisition unit for obtaining a sensor value outputted by the sensor indicating an operation intensity of the exercise assistance mechanism;

a combined load value derivation unit for deriving a combined load value which is a combined value of the assistance load value and an effective load value indicating amplitude of an exercising load applied to the user by the user's active exercise based on the sensor value obtained at the sensor value acquisition unit; and an exercise intensity derivation unit for deriving an exercise intensity indicating an exercise intensity of the user based on the effective load value computed as a difference between the assistance load value derived at the assistance load value derivation unit and the combined load value derived at the combined load value derivation unit.

2. The passive-type exercising device of claim 1, further comprising a heart rate acquisition unit for obtaining the user's heart rate, wherein the exercise intensity derivation unit includes:

a memory unit for storing in advance a plurality sets of correspondence relationship information between the user's heart rate and the exercise intensity defined for different amplitudes of the exercising loads;

a specifying unit for specifying corresponding relationship information corresponding to the effective load value computed as the difference between the assistance load value and the combined load value; and an exercise intensity acquisition unit for obtaining an exercise intensity corresponding to the heart rate obtained at the heart rate acquisition unit by referring to the correspondence relationship information specified at the specifying unit.

3. The passive-type exercising device of claim 1, further comprising a derivation result notification unit for notifying to the user at least one of the exercise intensity derived at the exercise intensity derivation unit and the effective load value computed as the difference between the assistance load value and the combined load value.

4. The passive-type exercising device of claim 1, further comprising a difference notification unit for performing a notification to the user in accordance with a difference between the effective load value and a desired value for the effective load value or a difference between an exercise intensity corresponding to the effective load value and an exercise intensity corresponding to the desired value for the effective load value.

5. The passive-type exercising device of claim 1, further comprising:

an exercise time acquisition unit for obtaining the user's exercise time;

a multiplication unit for multiplying the exercise intensity derived at the exercise intensity derivation unit and the exercise time obtained at the exercise time acquisition unit; and a multiplication result notification unit for notifying the multiplication result of the multiplication unit to the user.

6. The passive-type exercising device of claim 5, further comprising a body weight acquisition unit for obtaining the user's body weight, wherein the multiplication unit multiplies the exercise intensity derived at the exercise intensity derivation unit, the exercise time obtained at the exercise time acquisition unit, the body weight obtained at the body weight acquisition unit, and a predetermined coefficient.

7. The passive-type exercising device of claim 1, further comprising a load setting value adjustment unit for adjusting the load setting value based on a comparison result of a target exercise intensity that is a target value for the user's exercise intensity and the exercise intensity derived at the exercise intensity derivation unit, wherein the load setting value adjustment unit increases the load setting value when the exercise intensity derived at the exercise intensity derivation unit falls below the target exercise intensity, and wherein the load setting value adjustment unit decreases the load setting value when the exercise intensity derived at the exercise intensity derivation unit exceeds the target exercise intensity.

8. The passive-type exercising device of claim 1, further comprising an operation abort unit for stopping operations of the exercise assistance mechanism when a difference between a target exercise intensity that is a target value for the user's exercise intensity and the exercise intensity derived at the exercise intensity derivation unit exceeds a predetermined value.

9. The passive-type exercising device of claim 1, further comprising a voltage value acquisition unit for obtaining a voltage value of a power source supplying electricity to a drive unit provided at the exercise assistance mechanism, wherein the assistance load value derivation unit corrects the assistance load value in accordance with a fluctuation of the voltage value obtained at the voltage value acquisition unit.

10. A control device for controlling an exercise assistance mechanism for assisting exercise of a user as well as applying an exercising load to the user by operating in a predetermined operation pattern, comprising:

a load setting value acquisition unit for obtaining a load setting value which is a setting value for amplitude of the exercising load applied to the user by the exercise assistance mechanism;

an assistance load value derivation unit for deriving an assistance load value indicating amplitude of the user's exercising load reduced by the exercise assistance mechanism's assisting the exercise of the user;

a sensor value acquisition unit for obtaining a sensor value outputted by a sensor provided at the exercise assistance mechanism, the sensor value indicating an operation intensity of the exercise assistance mechanism;

a combined load value derivation unit for deriving a combined load value which is a combined value of the assistance load value and an effective load value indicating amplitude of an exercising load applied to the user by the user's active exercise based on the sensor value obtained at the sensor value acquisition unit; and an exercise intensity derivation unit for deriving an exercise intensity indicating an exercise intensity of the user based on the effective load value computed as a difference between the assistance load value derived at the assistance load value derivation unit and the combined load value derived at the combined load value derivation unit.

* * * * *